US007820035B2

(12) United States Patent
McCoy et al.

(10) Patent No.: US 7,820,035 B2
(45) Date of Patent: Oct. 26, 2010

(54) PROCESS FOR STEAM CRACKING HEAVY HYDROCARBON FEEDSTOCKS

(75) Inventors: James N. McCoy, Houston, TX (US); David B. Spicer, Houston, TX (US); Richard C. Stell, Houston, TX (US)

(73) Assignee: ExxonMobilChemical Patents Inc., Houston, TX (US)

( * ) Notice: Subject to any disclaimer, the term of this patent is extended or adjusted under 35 U.S.C. 154(b) by 1005 days.

(21) Appl. No.: 11/068,615

(22) Filed: Feb. 28, 2005

(65) Prior Publication Data

US 2005/0209495 A1 Sep. 22, 2005

Related U.S. Application Data

(60) Provisional application No. 60/555,282, filed on Mar. 22, 2004.

(51) Int. Cl.
*C10G 9/34* (2006.01)

(52) U.S. Cl. ..... 208/132; 208/130; 208/128; 585/648; 585/652

(58) Field of Classification Search ..... 208/48 R, 208/125–128, 130, 132, 650
See application file for complete search history.

(56) References Cited

U.S. PATENT DOCUMENTS

| | | | |
|---|---|---|---|
| 1,936,699 | A | 11/1933 | Weaver |
| 1,984,569 | A | 12/1934 | Cooke et al. |
| 2,091,261 | A | 8/1937 | Alther |
| 2,158,425 | A | 5/1939 | Ragatz |
| 3,291,573 | A | 12/1966 | Frescoln |
| 3,341,429 | A | 9/1967 | Fondrk |
| 3,413,211 | A | 11/1968 | Becraft et al. |
| 3,487,006 | A | 12/1969 | Newman et al. |
| 3,492,795 | A | 2/1970 | Guerrieri |
| 3,505,210 | A | 4/1970 | Wallace et al. |
| 3,617,493 | A | 11/1971 | Wirth et al. |
| 3,677,234 | A | 7/1972 | Dutkiewicz |
| 3,718,709 | A | 2/1973 | Simonetta |
| 3,900,300 | A | 8/1975 | Lehman |
| 4,199,409 | A | 4/1980 | Skraba |

(Continued)

FOREIGN PATENT DOCUMENTS

DE 1 093 351 11/1961

(Continued)

OTHER PUBLICATIONS

Dennis A. Duncan and Vance A. Ham, Stone & Webster, "The Practicalities of Steam-Cracking Heavy Oil", Mar. 29-Apr. 2, 1992 AIChE Spring National Meeting in New Orleans, LA, pp. 1-41.

(Continued)

*Primary Examiner*—Tam M Nguyen

(57) ABSTRACT

A process for cracking heavy hydrocarbon comprising heating the heavy hydrocarbon feedstock, mixing the heavy hydrocarbon feedstock with a fluid and/or a primary dilution steam stream to form a mixture, flashing the mixture to form a vapor phase and a liquid phase, separating and cracking the vapor phase, and cooling the product effluent in a transfer line exchanger, wherein the amount of the fluid and/or the primary dilution steam stream mixed with the heavy hydrocarbon feedstock is varied in accordance with at least one selected operating parameter of the process, such as the temperature of the flash stream before entering the flash/separator vessel.

35 Claims, 1 Drawing Sheet

U.S. PATENT DOCUMENTS

| | | | | |
|---|---|---|---|---|
| 4,264,432 | A | | 4/1981 | Gartside |
| 4,300,998 | A | | 11/1981 | Gartside |
| 4,311,580 | A | | 1/1982 | Bartholic |
| 4,321,130 | A | * | 3/1982 | Bacsik ..... 208/130 |
| 4,361,478 | A | | 11/1982 | Gengler et al. |
| 4,400,182 | A | | 8/1983 | Davies et al. |
| 4,426,278 | A | | 1/1984 | Kosters |
| 4,444,697 | A | | 4/1984 | Gater et al. |
| 4,543,177 | A | | 9/1985 | Murthy et al. |
| 4,615,795 | A | | 10/1986 | Woebcke et al. |
| 4,714,109 | A | | 12/1987 | Tsao ..... 165/104.18 |
| 4,732,740 | A | | 3/1988 | Woebcke et al. |
| 4,840,725 | A | | 6/1989 | Paspek |
| 4,854,944 | A | | 8/1989 | Strong |
| 4,954,247 | A | | 9/1990 | Lipkin et al. |
| 5,096,567 | A | | 3/1992 | Paspek, Jr. et al. |
| 5,120,892 | A | | 6/1992 | Skraba |
| 5,190,634 | A | | 3/1993 | Fernandez-Baujin et al. |
| 5,468,367 | A | | 11/1995 | Dickakian |
| 5,580,443 | A | | 12/1996 | Yoshida et al. |
| 5,817,226 | A | | 10/1998 | Lenglet |
| 5,910,440 | A | | 6/1999 | Grossman et al. |
| 6,093,310 | A | | 7/2000 | Swan |
| 6,123,830 | A | | 9/2000 | Gupta et al. |
| 6,179,997 | B1 | | 1/2001 | Vedder, Jr. et al. |
| 6,190,533 | B1 | | 2/2001 | Bradow et al. |
| 6,210,561 | B1 | | 4/2001 | Bradow et al. |
| 6,303,842 | B1 | | 10/2001 | Bridges et al. |
| 6,376,732 | B1 | | 4/2002 | Ngan et al. |
| 6,464,949 | B1 | | 10/2002 | Lenglet et al. |
| 6,632,351 | B1 | | 10/2003 | Ngan et al. |
| 6,743,961 | B2 | | 6/2004 | Powers |
| 7,090,765 | B2 | | 8/2006 | Spicer et al. |
| 7,097,758 | B2 | | 8/2006 | Stell et al. |
| 7,138,047 | B2 | | 11/2006 | Stell et al. |
| 7,247,765 | B2 | | 7/2007 | Stell et al. |
| 2001/0016673 | A1 | | 8/2001 | Bridges et al. |
| 2003/0070963 | A1 | | 4/2003 | Zimmermann et al. ..... 208/106 |
| 2004/0004022 | A1 | | 1/2004 | Stell et al. |
| 2004/0004027 | A1 | | 1/2004 | Spicer et al. |
| 2004/0004028 | A1 | | 1/2004 | Stell et al. |
| 2004/0054247 | A1 | | 3/2004 | Powers |
| 2005/0010075 | A1 | | 1/2005 | Powers |

FOREIGN PATENT DOCUMENTS

| | | |
|---|---|---|
| EP | 0 063 448 | 10/1982 |
| EP | 0 423 960 | 4/1991 |
| EP | 0 434 049 | 6/1991 |
| FR | 1 472 280 | 3/1967 |
| GB | 199 766 | 6/1923 |
| GB | 998 504 | 7/1965 |
| GB | 1 053 751 | 1/1967 |
| GB | 1 203 017 | 8/1970 |
| GB | 1 233 795 | 5/1971 |
| GB | 2 006 259 | 2/1979 |
| GB | 2 012 176 | 7/1979 |
| JP | 02-245235 | 10/1990 |
| JP | 3111491 | 5/1991 |
| JP | 06-116568 | 4/1994 |
| NL | 7410163 | 4/1975 |
| SU | 1491552 | 7/1989 |
| WO | WO 97/49782 | 12/1997 |
| WO | WO 01/55280 | 8/2001 |
| WO | WO 2004/005431 | 1/2004 |
| WO | WO 2004/005432 | 1/2004 |
| WO | WO 2004/005433 | 1/2004 |
| ZA | 907394 | 9/1990 |

OTHER PUBLICATIONS

ABB Lummus Crest Inc., (presentation) HOPS, "Heavy Oil Processing System", Jun. 15, 1992 TCC PEW Meeting, pp. 1-18.

"Specialty Furnace Design: Steam Reformers and Steam Crackers", presented by T.A. Wells of the M.W. Kellogg Company, 1988 AIChE Spring National Meeting.

Mitsui Sekka Engineering Co., Ltd./Mitsui Engineering & Shipbuilding Co., Ltd., "*Mitsui Advanced Cracker & Mitsui Innovative Quencher*", Nov. 1997, pp. 1-16.

* cited by examiner

PROCESS FOR STEAM CRACKING HEAVY HYDROCARBON FEEDSTOCKS

CROSS REFERENCE TO RELATED APPLICATION

This application claims benefit to U.S. provisional application No. 60/555,282, filed on Mar. 22, 2004.

FIELD OF THE INVENTION

The present invention relates to the cracking of hydrocarbons that contain relatively non-volatile hydrocarbons and other contaminants.

BACKGROUND OF THE INVENTION

Steam cracking, also referred to as pyrolysis, has long been used to crack various hydrocarbon feedstocks into olefins, preferably light olefins such as ethylene, propylene, and butenes. Conventional steam cracking utilizes a pyrolysis furnace which has two main sections: a convection section and a radiant section. The hydrocarbon feedstock typically enters the convection section of the furnace as a liquid (except for light feedstocks which enter as a vapor) wherein it is typically heated and vaporized by indirect contact with hot flue gas from the radiant section and by direct contact with steam. The vaporized feedstock and steam mixture is then introduced into the radiant section where the cracking takes place. The resulting products including olefins leave the pyrolysis furnace for further downstream processing, including quenching.

Pyrolysis involves heating the feedstock sufficiently to cause thermal decomposition of the larger molecules. The pyrolysis process, however, produces molecules which tend to combine to form high molecular weight materials known as tar. Tar is a high-boiling point, viscous, reactive material that can foul equipment under certain conditions. In general, feedstocks containing higher boiling materials tend to produce greater quantities of tar.

The formation of tar after the pyrolysis effluent leaves the steam cracking furnace can be minimized by rapidly reducing the temperature of the effluent exiting the pyrolysis unit to a level at which the tar-forming reactions are greatly slowed. This cooling, which may be achieved in one or more steps and using one or more methods, is referred to as quenching.

Conventional steam cracking systems have been effective for cracking high-quality feedstock which contain a large fraction of light volatile hydrocarbons, such as gas oil and naphtha. However, steam cracking economics sometimes favor cracking lower cost heavy feedstocks such as, by way of non-limiting examples, crude oil and atmospheric residue. Crude oil and atmospheric residue often contain high molecular weight, non-volatile components with boiling points in excess of 1100° F. (590° C.). The non-volatile components of these feedstocks lay down as coke in the convection section of conventional pyrolysis furnaces. Only very low levels of non-volatile components can be tolerated in the convection section downstream of the point where the lighter components have fully vaporized.

In most commercial naphtha and gas oil crackers, cooling of the effluent from the cracking furnace is normally achieved using a system of transfer line heat exchangers, a primary fractionator, and a water quench tower or indirect condenser. The steam generated in transfer line exchangers can be used to drive large steam turbines which power the major compressors used elsewhere in the ethylene production unit. To obtain high energy-efficiency and power production in the steam turbines, it is necessary to superheat the steam produced in the transfer line exchangers.

The integration of transfer line exchangers with their corresponding high-pressure steam superheaters in a conventional steam cracking furnace (e.g., cracking naphtha feed) is shown in FIG. 7 of the paper "Specialty Furnace Design: Steam Reformers and Steam Crackers," presented by T. A. Wells of the M.W. Kellogg Company, 1988 AIChE Spring National Meeting.

Cracking heavier feeds, such as kerosenes and gas oils, produces large amounts of tar, which lead to rapid coking in the radiant section of the furnace as well as fouling in the transfer line exchangers preferred in lighter liquid cracking service.

Additionally, during transport some naphthas are contaminated with heavy crude oil containing non-volatile components. Conventional pyrolysis furnaces do not have the flexibility to process residues, crudes, or many residue or crude-contaminated gas oils or naphthas which are contaminated with non-volatile components.

To address coking problems, U.S. Pat. No. 3,617,493, which is incorporated herein by reference, discloses the use of an external vaporization drum for the crude oil feed and discloses the use of a first flash to remove naphtha as vapor and a second flash to remove vapors with a boiling point between 450 and 1100° F. (230 and 590° C.). The vapors are cracked in the pyrolysis furnace into olefins and the separated liquids from the two flash tanks are removed, stripped with steam, and used as fuel.

U.S. Pat. No. 3,718,709, which is incorporated herein by reference, discloses a process to minimize coke deposition. It describes preheating of heavy feedstock inside or outside a pyrolysis furnace to vaporize about 50% of the heavy feedstock with superheated steam and the removal of the residual, separated liquid. The vaporized hydrocarbons, which contain mostly light volatile hydrocarbons, are subjected to cracking.

U.S. Pat. No. 5,190,634, which is incorporated herein by reference, discloses a process for inhibiting coke formation in a furnace by preheating the feedstock in the presence of a small, critical amount of hydrogen in the convection section. The presence of hydrogen in the convection section inhibits the polymerization reaction of the hydrocarbons thereby inhibiting coke formation.

U.S. Pat. No. 5,580,443, which is incorporated herein by reference, discloses a process wherein the feedstock is first preheated and then withdrawn from a preheater in the convection section of the pyrolysis furnace. This preheated feedstock is then mixed with a pre-determined amount of steam (the dilution steam) and is then introduced into a gas-liquid separator to separate and remove a required proportion of the non-volatiles as liquid from the separator. The separated vapor from the gas-liquid separator is returned to the pyrolysis furnace for heating and cracking.

In using a flash to separate heavy liquid hydrocarbon fractions from the lighter fractions which can be processed in the pyrolysis furnace, it is important to effect the separation so that most of the non-volatile components will be in the liquid phase. Otherwise, heavy, coke-forming non-volatile components in the vapor are carried into the furnace causing coking problems.

The control of the ratio of vapor to liquid leaving flash has been found to be difficult because many variables are involved, including the temperature of the stream entering the flash. The temperature of the stream entering the flash varies as the furnace load changes. The temperature is higher when the furnace is at full load and is lower when the furnace is at partial load. The temperature of the stream entering the flash also varies according to the flue-gas temperature in the furnace that heats the feedstock. The flue-gas temperature in turn varies according to the extent of coking that has occurred in the furnace. When the furnace is clean or very lightly coked, the flue-gas temperature is lower than when the furnace is heavily coked. The flue-gas temperature is also a function of the combustion control exercised on the burners of the furnace. When the furnace is operated with low levels of excess oxygen in the flue gas, the flue-gas temperature in the middle to upper zones of the convection section will be lower than that when the furnace is operated with higher levels of excess oxygen in the flue gas.

Co-pending U.S. application Ser. No. 10/188,461, filed Jul. 3, 2002, which is incorporated herein by reference, describes an advantageously controlled process to optimize the cracking of volatile hydrocarbons contained in the heavy hydrocarbon feedstocks and to reduce and avoid the coking problems. It provides a method to maintain a relatively constant ratio of vapor to liquid leaving the flash by maintaining a relatively constant temperature of the stream entering the flash. More specifically, the constant temperature of the flash stream is maintained by automatically adjusting the amount of a fluid stream mixed with the heavy hydrocarbon feedstock prior to the flash. The fluid can be water.

To avoid coke deposition in the first stage of preheating in the convection section (and excessive coking in the radiant and quench systems) the mixed and partially vaporized feed and dilution steam stream is generally withdrawn from the convection section before the feed is fully vaporized and before excessive film temperatures are developed in the convection section tubes. Excessive film temperatures, such as above about 950° F. (510° C.) to above about 1150° F. (620° C.) depending on the feedstock, are theorized to lead to excessive coke formation from the heavy end of the heavy hydrocarbon feedstock stream.

The present invention provides for the use of a transfer line exchanger in conjunction with the invention of U.S. application Ser. No. 10/188,461 to allow more efficient quench operations despite the heavy hydrocarbon feedstock. It further provides for an optimization such that the steam generated in the transfer line exchanger is superheated in such a way that the film temperature upstream of the flash is controlled to reduce coking in the convection section of the furnace.

SUMMARY OF THE INVENTION

The present invention provides a process for cracking heavy hydrocarbon feedstock which comprises heating a heavy hydrocarbon feedstock, mixing the heavy hydrocarbon feedstock with a fluid to form a mixture stream, flashing the mixture stream to form a vapor phase and a liquid phase, removing the liquid phase, cracking the vapor phase in the radiant section of a pyrolysis furnace to produce an effluent comprising olefins, and quenching the effluent using a transfer line exchanger, wherein the amount of the fluid mixed with the heavy hydrocarbon feedstock is varied in accordance with at least one selected operating parameter of the process. The fluid can be a hydrocarbon or water, preferably water.

Some non-limiting examples of operating parameters controlled in the inventive process are the temperature of the mixture stream before the mixture stream is flashed, the pressure of the flash, the temperature of the flash, the flow rate of the mixture stream, and/or the excess oxygen in the flue gas of the furnace.

The heavy hydrocarbon feedstock used in this invention can comprise one or more of steam cracked gas oil and residues, gas oils, heating oil, jet fuel, diesel, kerosene, gasoline, coker naphtha, steam cracked naphtha, catalytically cracked naphtha, hydrocrackate, reformate, raffinate reformate, Fischer-Tropsch liquids, Fischer-Tropsch gases, natural gasoline, distillate, virgin naphtha, crude oil, atmospheric pipestill bottoms, vacuum pipestill streams including bottoms, wide boiling range naphtha to gas oil condensates, heavy non-virgin hydrocarbon streams from refineries, vacuum gas oils, heavy gas oil, naphtha contaminated with crude, atmospheric residue, heavy residue, $C_4$'s/residue admixture, naphtha/residue admixture, gas oil/residue admixture, and crude oil. Preferably, the heavy hydrocarbon feedstock has a nominal final boiling point of at least 600° F. (310° C.).

In applying this invention, the heavy hydrocarbon feedstock may be heated by indirect contact with flue gas in a first convection section tube bank of the pyrolysis furnace before mixing with the fluid. Preferably, the temperature of the heavy hydrocarbon feedstock is from 300 to 500° F. (150 to 260° C.) before mixing with the fluid.

Following step (b), the mixture stream may be heated by indirect contact with flue gas in a first convection section of the pyrolysis furnace before being flashed. Preferably, the first convection section is arranged to add the fluid, and optionally primary dilution steam, between passes of that section such that the heavy hydrocarbon feedstock can be heated before mixing with the fluid and the mixture stream can be further heated before being flashed.

The temperature of the flue gas entering the first convection section tube bank is generally less than about 1500° F., for example less than about 1300° F., such as less than about 1150° F., and preferably less than about 1000° F.

Dilution steam may be added at any point in the process, for example, it may be added to the heavy hydrocarbon feedstock before or after heating, to the mixture stream, and/or to the vapor phase. Any dilution steam stream may comprise sour steam. Any dilution steam stream may be heated or superheated in a convection section tube bank located anywhere within the convection section of the furnace, preferably in the first or second tube bank.

The mixture stream may be at about 600 to about 1000° F. (315 to 540° C.) before the flash in step (c), and the flash pressure may be about 40 to about 200 psia. Following the flash, 50 to 98% of the mixture stream may be in the vapor phase. An additional separator such as a centrifugal separator may be used to remove trace amounts of liquid from the vapor phase. The vapor phase may be heated to above the flash temperature before entering the radiant section of the furnace, for example to about 800 to 1300° F. (425 to 705° C.). This heating may occur in a convection section tube bank, preferably the tube bank nearest the radiant section of the furnace.

The transfer line exchanger can be used to produce high pressure steam which is then preferably superheated in a convection section tube bank of the pyrolysis furnace, typically to a temperature less than about 1100° F. (590° C.), for example about 850 to about 950° F. (455 to 510° C.) by indirect contact with the flue gas before the flue gas enters the convection section tube bank used for heating the heavy hydrocarbon feedstock and/or mixture stream. An intermediate desuperheater may be used to control the temperature of the high pressure steam. The high pressure steam is preferably at a pressure of about 600 psig or greater and may have a pressure of about 1500 to about 2000 psig. The high pressure steam superheater tube bank is preferably located between the first convection section tube bank and the tube bank used for heating the vapor phase.

Alternatively, the process can comprise heating a heavy hydrocarbon feedstock, mixing the heavy hydrocarbon feedstock with a fluid to form a mixture stream, flashing the mixture stream to form a vapor phase and a liquid phase, removing the liquid phase, cracking the vapor phase in the radiant section of a pyrolysis furnace to produce an effluent comprising olefins, and quenching the effluent using a transfer line exchanger, wherein the transfer line exchanger is used to produce high pressure steam which is superheated in a convection section tube bank located such that the flue gas heats the high pressure steam prior to contacting tube banks containing the heavy hydrocarbon feedstock and/or the mixture stream. The heavy hydrocarbon feedstock, fluid, optional steam streams, pressures, and temperatures are all as described above.

DETAILED DESCRIPTION OF THE INVENTION

Figure 1:
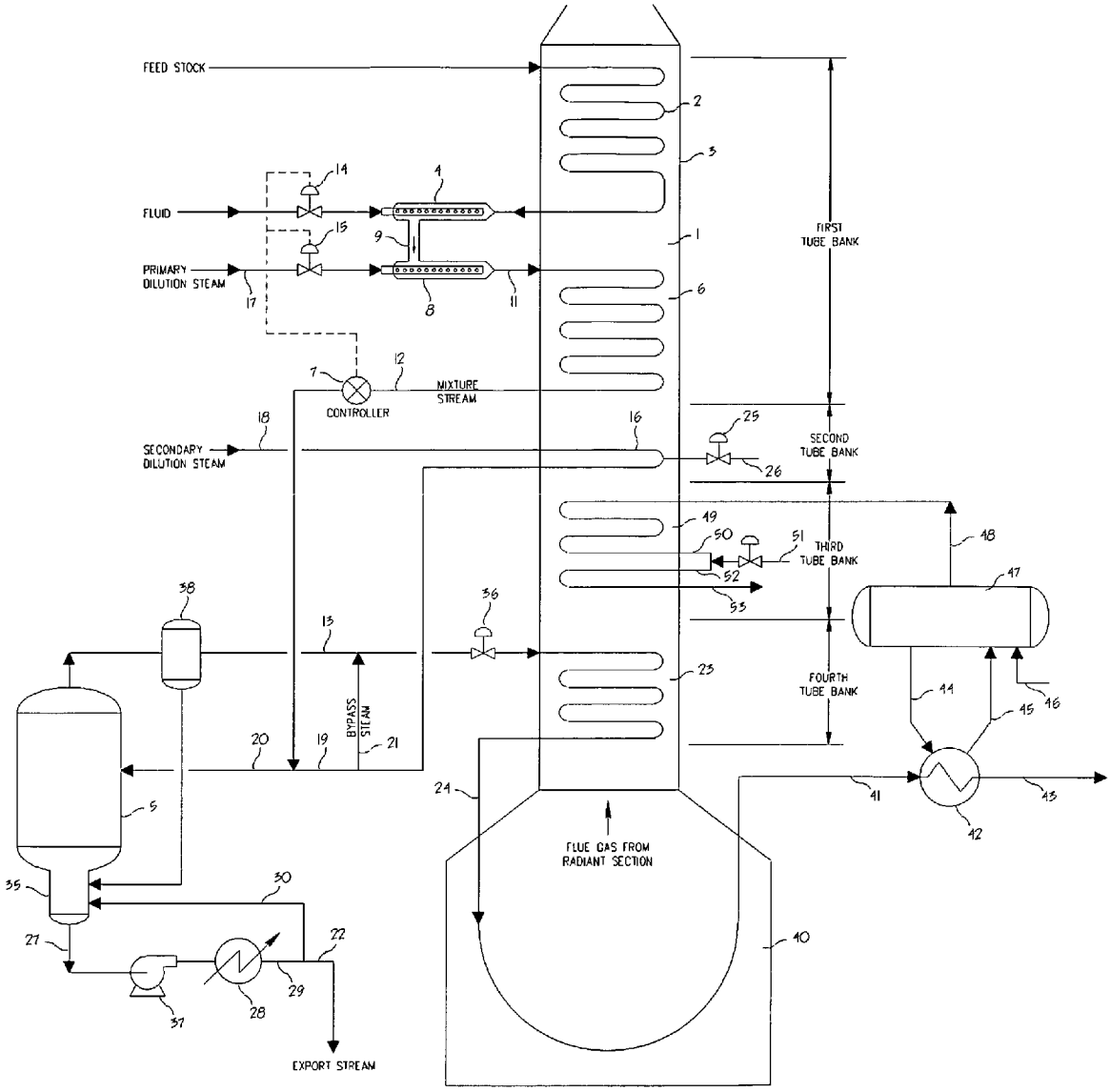
FIG. 1 illustrates a schematic flow diagram of a process in accordance with the present invention employed with a pyrolysis furnace.

Unless otherwise stated, all percentages, parts, ratios, etc., are by weight. Unless otherwise stated, a reference to a compound or component includes the compound or component by itself, as well as in combination with other compounds or components, such as mixtures of compounds.

Further, when an amount, concentration, or other value or parameter is given as a list of upper preferable values and lower preferable values, this is to be understood as specifically disclosing all ranges formed from any pair of an upper preferred value and a lower preferred value, regardless whether ranges are separately disclosed.

As used herein, non-volatile components are the fraction of the hydrocarbon feed with a nominal boiling point above 1100° F. (590° C.) as measured by ASTM D-6352-98 or D-2887. This invention works very well with non-volatiles having a nominal boiling point above about 1400° F. (760° C.). The boiling point distribution of the hydrocarbon feed is measured by Gas Chromatograph Distillation (GCD) according to the methods described in ASTM D-6352-98 or D-2887, extended by extrapolation for materials boiling above 700° C. (1292° F.). Non-volatile components can include coke precursors, which are moderately heavy and/or reactive molecules, such as multi-ring aromatic compounds, which can condense from the vapor phase and then form coke under the operating conditions encountered in the present process of the invention. Nominal final boiling point shall mean the temperature at which 99.5 weight percent of a particular sample has reached its boiling point.

The present invention relates to a process for heating and steam cracking heavy hydrocarbon feedstock. The process comprises heating a heavy hydrocarbon feedstock, mixing the heavy hydrocarbon feedstock with a fluid to form a mixture, flashing the mixture to form a vapor phase and a liquid phase, preferably varying the amount of fluid mixed with the heavy hydrocarbon feedstock in accordance with at least one selected operating parameter of the process, feeding the vapor phase to the radiant section of a pyrolysis furnace, and subsequently quenching the reaction using a transfer line exchanger.

The heavy hydrocarbon feedstock can comprise a large portion, such as about 5 to about 50%, of heavy non-volatile components. Such feedstock could comprise, by way of non-limiting examples, one or more of steam cracked gas oil and residues, gas oils, heating oil, jet fuel, diesel, kerosene, gasoline, coker naphtha, steam cracked naphtha, catalytically cracked naphtha, hydrocrackate, reformate, raffinate reformate, Fischer-Tropsch liquids, Fischer-Tropsch gases, natural gasoline, distillate, virgin naphtha, crude oil, atmospheric pipestill bottoms, vacuum pipestill streams including bottoms, wide boiling range naphtha to gas oil condensates, heavy non-virgin hydrocarbon streams from refineries, vacuum gas oils, heavy gas oil, naphtha contaminated with crude, atmospheric residue, heavy residue, $C_4$'s/residue admixture, naphtha/residue admixture, gas oil/residue admixture, and crude oil.

The heavy hydrocarbon feedstock can have a nominal end boiling point of at least about 600° F. (315° C.), generally greater than about 950° F. (510° C.), typically greater than about 1100° F. (590° C.), for example greater than about 1400° F. (760° C.). The economically preferred feedstocks are generally low sulfur waxy residues, atmospheric residues, naphthas contaminated with crude, and various residue admixtures.

The heating of the heavy hydrocarbon feedstock can take any form known by those of ordinary skill in the art. However, it is preferred that the heating comprises indirect contact of the heavy hydrocarbon feedstock in the upper (farthest from the radiant section) convection section tube bank 2 of the furnace 1 with hot flue gases from the radiant section of the furnace. This can be accomplished, by way of non-limiting example, by passing the heavy hydrocarbon feedstock through a bank of heat exchange tubes 2 located within the convection section 3 of the furnace 1. The heated heavy hydrocarbon feedstock typically has a temperature between about 300 and about 500° F. (150 and 260° C.), such as about 325 to about 450° F. (160 to 230° C.), for example about 340 to about 425° F. (170 to 220° C.).

The heated heavy hydrocarbon feedstock is mixed with a fluid which can be a hydrocarbon, preferably liquid, but optionally vapor; water; steam; or a mixture thereof. The preferred fluid is water. A source of the fluid can be low pressure boiler feed water. The temperature of the fluid can be below, equal to, or above the temperature of the heated feedstock.

The mixing of the heated heavy hydrocarbon feedstock and the fluid can occur inside or outside the pyrolysis furnace 1, but preferably it occurs outside the furnace. The mixing can be accomplished using any mixing device known within the art. For example, it is possible to use a first sparger 4 of a double sparger assembly 9 for the mixing. The first sparger 4 can avoid or reduce hammering, caused by sudden vaporization of the fluid, upon introduction of the fluid into the heated heavy hydrocarbon feedstock.

The present invention uses optional steam streams in various parts of the process. The primary dilution steam stream 17 can be mixed with the heated heavy hydrocarbon feedstock as detailed below. In another embodiment, a secondary dilution steam stream 18 can be heated in the convection section and mixed with the heated mixture steam before the flash. The source of the secondary dilution steam may be primary dilution steam which has been superheated, optionally in a convection section of the pyrolysis furnace. Either or both of the primary and secondary dilution steam streams may comprise sour steam. Superheating the sour dilution steam minimizes the risk of corrosion which could result from condensation of sour steam.

In one embodiment of the present invention, in addition to the fluid mixed with the heated heavy feedstock, the primary dilution steam stream 17 is also mixed with the feedstock. The primary dilution steam stream can be preferably injected into a second sparger 8. It is preferred that the primary dilution steam stream is injected into the heavy hydrocarbon fluid mixture before the resulting stream mixture optionally enters the convection section at 11 for additional heating by flue gas, generally within the same tube bank as would have been used for heating the heavy hydrocarbon feedstock.

The primary dilution steam can have a temperature greater than, lower than, or about the same as heavy hydrocarbon feedstock fluid mixture, but preferably the temperature is greater than that of the mixture and serves to partially vaporize the feedstock/fluid mixture. The primary dilution steam may be superheated before being injected into the second sparger 8.

The mixture stream comprising the heated heavy hydrocarbon feedstock, the fluid, and the optional primary dilution steam stream leaving the second sparger 8 is optionally heated again in the convection section of the pyrolysis furnace 3 before the flash. The heating can be accomplished, by way of non-limiting example, by passing the mixture stream through a bank of heat exchange tubes 6 located within the convection section, usually as part of the first convection section tube bank, of the furnace and thus heated by the hot flue gas from the radiant section of the furnace. The thus-heated mixture stream leaves the convection section as a mixture stream 12 to optionally be further mixed with an additional steam stream.

Optionally, the secondary dilution steam stream 18 can be further split into a flash steam stream 19 which is mixed with the heavy hydrocarbon mixture stream 12 before the flash and a bypass steam stream 21 which bypasses the flash of the heavy hydrocarbon mixture and is instead mixed with the vapor phase from the flash before the vapor phase is cracked in the radiant section of the furnace. The present invention can operate with all secondary dilution steam stream 18 used as flash steam stream 19 with no bypass steam stream 21. Alternatively, the present invention can be operated with secondary dilution steam stream 18 directed to bypass steam stream 21 with no flash steam stream 19. In a preferred embodiment in accordance with the present invention, the ratio of the flash steam stream 19 to bypass steam stream 21 should be preferably 1:20 to 20:1, more preferably 1:2 to 2:1. In this embodiment, the flash steam stream 19 is mixed with the heavy hydrocarbon mixture stream 12 to form a flash stream 20 before the flash in flash/separator vessel 5. Preferably, the secondary dilution steam stream is superheated in a superheater section 16 in the furnace convection before splitting and mixing with the heavy hydrocarbon mixture. The addition of the flash steam stream 19 to the heavy hydrocarbon mixture stream 12 aids the vaporization of most volatile components of the mixture before the flash stream 20 enters the flash/separator vessel 5.

The mixture stream 12 or the flash stream 20 is then flashed, for example in a flash/separator vessel 5, for separation into two phases: a vapor phase comprising predominantly volatile hydrocarbons and steam and a liquid phase comprising predominantly non-volatile hydrocarbons. The vapor phase is preferably removed from the flash/separator vessel 5 as an overhead vapor stream 13. The vapor phase is preferably fed back to a convection section tube bank 23 of the furnace, preferably located nearest the radiant section of the furnace, for optional heating and through crossover pipes 24 to the radiant section 40 of the pyrolysis furnace for cracking. The liquid phase of the flashed mixture stream is removed from the flash/separator vessel 5 as a bottoms stream 27.

It is preferred to maintain a pre-determined constant ratio of vapor to liquid in the flash/separator vessel 5, but such ratio is difficult to measure and control. As an alternative, temperature of the mixture stream 12 before the flash/separator vessel 5 can be used as an indirect parameter to measure, control, and maintain an approximately constant vapor to liquid ratio in the flash/separator vessel 5. Ideally, when the mixture stream temperature is higher, more volatile hydrocarbons will be vaporized and become available, as a vapor phase, for cracking. However, when the mixture stream temperature is too high, more heavy hydrocarbons will be present in the vapor phase and carried over to the convection furnace tubes, eventually coking the tubes. If the mixture stream 12 temperature is too low, resulting in a low ratio of vapor to liquid in the flash/separator vessel 5, more volatile hydrocarbons will remain in liquid phase and thus will not be available for cracking.

The mixture stream temperature is optimally controlled to maximize recovery/vaporization of volatiles in the feedstock while avoiding excessive coking in the furnace tubes or coking in piping and vessels conveying the mixture from the flash/separator vessel to the furnace 3. The pressure drop across the piping and vessels conveying the mixture to the lower convection section 23 and the crossover piping 24 and the temperature rise across the lower convection section 23 may be monitored to detect the onset of coking problems. For instance, when the crossover pressure and process inlet pressure to the lower convection section 23 begins to increase rapidly due to coking, the temperature in the flash/separator vessel 5 and the mixture stream 12 should be reduced. If coking occurs in the lower convection section, the temperature of the flue gas to the superheater section 16 increases, requiring more desuperheater water 26.

The selection of the mixture stream 12 temperature is also determined by the composition of the feedstock materials. When the feedstock contains higher amounts of lighter hydrocarbons, the temperature of the mixture stream 12 can be set lower. As a result, the amount of fluid used in the first sparger 4 would be increased and/or the amount of primary dilution steam used in the second sparger 8 would be decreased since these amounts directly impact the temperature of the mixture stream 12. When the feedstock contains a higher amount of non-volatile hydrocarbons, the temperature of the mixture stream 12 should be set higher. As a result, the amount of fluid used in the first sparger 4 would be decreased while the amount of primary dilution steam used in the second sparger 8 would be increased. By carefully selecting a mixture stream temperature, the present invention can find applications in a wide variety of feedstock materials.

Typically, the temperature of the mixture stream 12 can be set and controlled at between about 600 and about 1000° F. (315 and 540° C.), such as between about 700 and about 950° F. (370 and 510° C.), for example between about 750 and about 900° F. (400 and 480° C.), and often between about 810 and about 890° F. (430 and 475° C.). These values will change with the concentration of volatiles in the feedstock as discussed above.

Considerations in determining the temperature include the desire to maintain a liquid phase to reduce the likelihood of coke formation on exchanger tube walls and in the flash/separator.

The temperature of mixture stream 12 can be controlled by a control system 7 which comprises at least a temperature sensor and any known control device, such as a computer application. Preferably, the temperature sensors are thermocouples. The control system 7 communicates with the fluid valve 14 and the primary dilution steam valve 15 so that the amount of the fluid and the primary dilution steam entering the two spargers can be controlled.

In order to maintain a constant temperature for the mixture stream 12 mixing with flash steam stream 19 and entering the flash/separator vessel 5 to achieve a constant ratio of vapor to liquid in the flash/separator vessel 5, and to avoid substantial temperature and flash vapor to liquid ratio variations, the present invention operates as follows: When a temperature for the mixture stream 12 before the flash/separator vessel 5 is set, the control system 7 automatically controls the fluid valve 14 and primary dilution steam valve 15 on the two spargers. When the control system 7 detects a drop of temperature of the mixture stream, it will cause the fluid valve 14 to reduce the injection of the fluid into the first sparger 4. If the temperature of the mixture stream starts to rise, the fluid valve will be opened wider to increase the injection of the fluid into the first sparger 4. In one possible embodiment, the fluid latent heat of vaporization controls mixture stream temperature.

When the primary dilution steam stream 17 is injected to the second sparger 8, the temperature control system 7 can also be used to control the primary dilution steam valve 15 to adjust the amount of primary dilution steam stream injected into the second sparger 8. This further reduces the sharp variation of temperature changes in the flash/separator vessel 5. When the control system 7 detects a drop of temperature of the mixture stream 12, it will instruct the primary dilution steam valve 15 to increase the injection of the primary dilution steam stream into the second sparger 8 while fluid valve 14 is closed more. If the temperature starts to rise, the primary dilution steam valve will automatically close more to reduce the primary dilution steam stream injected into the second sparger 8 while fluid valve 14 is opened wider.

In one embodiment in accordance with the present invention, the control system 7 can be used to control both the amount of the fluid and the amount of the primary dilution steam stream to be injected into both spargers.

In an example embodiment where the fluid is water, the controller varies the amount of water and primary dilution steam to maintain a constant mixture stream 12 temperature, while maintaining a constant ratio of water-to-feedstock in the mixture 11. To further avoid sharp variation of the flash temperature, the present invention also preferably utilizes an intermediate desuperheater 25 in the superheating section of the secondary dilution steam in the furnace. This allows the superheater 16 outlet temperature to be controlled at a constant value, independent of furnace load changes, coking extent changes, excess oxygen level changes, and other variables. Normally, this desuperheater 25 maintains the temperature of the secondary dilution steam between about 800 and about 1100° F. (425 and 590° C.), for example between about 850 and about 10001° F. (455 and 540° C.), such as between about 850 and about 950° F. (455 and 510° C.), and typically between about 875 and about 925° F. (470 and 495° C.). The desuperheater can be a control valve and water atomizer nozzle. After partial preheating, the secondary dilution steam exits the convection section and a fine mist of desuperheater water 26 can be added which rapidly vaporizes and reduces the temperature. The steam is preferably then further heated in the convection section. The amount of water added to the superheater can control the temperature of the steam which is optionally mixed with mixture stream 12.

Although the description above is based on adjusting the amounts of the fluid and the primary dilution steam streams injected into the heavy hydrocarbon feedstock in the two spargers 4 and 8, according to the pre-determined temperature of the mixture stream 12 before the flash/separator vessel 5, the same control mechanisms can be applied to other parameters at other locations. For instance, the flash pressure and the temperature and the flow rate of the flash steam stream 19 can be changed to effect a change in the vapor to liquid ratio in the flash. Also, excess oxygen in the flue gas can also be a control variable, albeit a slow one.

In addition to maintaining a constant temperature of the mixture stream 12 entering the flash/separator vessel, it is generally also desirable to maintain a constant hydrocarbon partial pressure of the flash stream 20 in order to maintain a constant ratio of vapor to liquid in the flash/separator vessel. By way of examples, the constant hydrocarbon partial pressure can be maintained by maintaining constant flash/separator vessel pressure through the use of control valve 36 on the vapor phase line 13 and by controlling the ratio of steam to hydrocarbon feedstock in stream 20.

Typically, the hydrocarbon partial pressure of the flash stream in the present invention is set and controlled at between about 4 and about 25 psia (25 and 175 kPa), such as between about 5 and about 15 psia (35 and 100 kPa), for example between about 6 and about 11 psia (40 and 75 kPa).

In one embodiment, the flash is conducted in at least one flash/separator vessel. Typically the flash is a one-stage process with or without reflux. The flash/separator vessel 5 is normally operated at about 40 to about 200 psia (275 to 1400 kPa) pressure and its temperature is usually the same or slightly lower than the temperature of the flash stream 20 before entering the flash/separator vessel 5. Typically, the pressure at which the flash/separator vessel operates is about 40 to about 200 psia (275 to 1400 kPa) and the temperature is about 600 to about 1000° F. (310 to 540° C.). For example, the pressure of the flash can be about 85 to about 155 psia (600 to 1100 kPa) and the temperature can be about 700 to about 920° F. (370 to 490° C.). As a further example, the pressure of the flash can be about 105 to about 145 psia (700 to 1000 kPa) with a temperature of about 750 to about 900° F. (400 to 480° C.). In yet another example, the pressure of the flash/separator vessel can be about 105 to about 125 psia (700 to 760 kPa) and the temperature can be about 810 to about 890° F. (430 to 475° C.). Depending on the temperature of the mixture stream 12, generally about 50 to about 98% of the mixture stream being flashed is in the vapor phase, such as about 60 to about 95%, for example about 65 to about 90%.

The flash/separator vessel 5 is generally operated, in one aspect, to minimize the temperature of the liquid phase at the bottom of the vessel because too much heat may cause coking of the non-volatiles in the liquid phase. Use of the secondary dilution steam stream 18 in the flash stream entering the flash/separator vessel lowers the vaporization temperature because it reduces the partial pressure of the hydrocarbons (i.e., a larger mole fraction of the vapor is steam) and thus lowers the required liquid phase temperature. It may also be helpful to recycle a portion of the externally cooled flash/separator vessel bottoms liquid 30 back to the flash/separator vessel to help cool the newly separated liquid phase at the bottom of the flash/separator vessel 5. Stream 27 can be conveyed from the bottom of the flash/separator vessel 5 to the cooler 28 via pump 37. The cooled stream 29 can then be split into a recycle stream 30 and export stream 22. The temperature of the recycled stream would typically be about 500 to about 600° F. (260 to 315° C.), for example about 520 to about 550° F. (270 to 290° C.). The amount of recycled stream can be about 80 to about 250% of the amount of the newly separated bottom liquid inside the flash/separator vessel, such as about 90 to about 225%, for example about 100 to about 200%.

The flash is generally also operated, in another aspect, to minimize the liquid retention/holding time in the flash vessel. In one example embodiment, the liquid phase is discharged from the vessel through a small diameter "boot" or cylinder 35 on the bottom of the flash/separator vessel. Typically, the liquid phase retention time in the drum is less than about 75 seconds, for example less than about 60 seconds, such as less than about 30 seconds, and often less than about 15 seconds. The shorter the liquid phase retention/holding time in the flash/separator vessel, the less coking occurs in the bottom of the flash/separator vessel.

The vapor phase may contain, for example, about 55 to about 70% hydrocarbons and about 30 to about 45% steam. The boiling end point of the vapor phase is normally below about 1400° F. (760° C.), such as below about 1100° F. (590° C.), for example below about 1050° F. (565° C.), and often below about 1000° F. (540° C.). The vapor phase is continuously removed from the flash/separator vessel 5 through an overhead pipe which optionally conveys the vapor to a centrifugal separator 38 which removes trace amounts of entrained and/or condensed liquid. The vapor then typically flows into a manifold that distributes the flow to the convection section of the furnace.

The vapor phase stream 13 continuously removed from the flash/separator vessel is preferably superheated in the pyrolysis furnace lower convection section 23 to a temperature of, for example, about 800 to about 1300° F. (425 to 705° C.) by the flue gas from the radiant section of the furnace. The vapor phase is then introduced to the radiant section of the pyrolysis furnace to be cracked.

The vapor phase stream 13 removed from the flash/separator vessel can optionally be mixed with a bypass steam stream 21 before being introduced into the furnace lower convection section 23.

The bypass steam stream 21 is a split steam stream from the secondary dilution steam stream 18. Preferably, the secondary dilution steam is first heated in the convection section of the pyrolysis furnace 3 before splitting and mixing with the vapor phase stream removed from the flash/separator vessel 5. In some applications, it may be possible to superheat the bypass steam again after the splitting from the secondary dilution steam but before mixing with the vapor phase. The superheating after the mixing of the bypass steam stream 21 with the vapor phase stream 13 ensures that all but the heaviest components of the mixture in this section of the furnace are vaporized before entering the radiant section. Raising the temperature of vapor phase to 800 to 1300° F. (425 to 705° C.) in the lower convection section 23 also helps the operation in the radiant section since radiant tube metal temperature can be reduced. This results in less coking potential in the radiant section. The superheated vapor is then cracked in the radiant section of the pyrolysis furnace.

Because the controlled flash of the mixture stream results in significant removal of the coke- and tar-producing heavier hydrocarbon species (in the liquid phase), it is possible to utilize a transfer line exchanger for quenching the effluent from the radiant section of the pyrolysis furnace. Among other benefits, this will allow more cost-effective retrofitting of cracking facilities initially designed for lighter feeds, such as naphthas, or other liquid feedstocks with end boiling points generally below about 600° F. (315° C.), which have transfer line exchanger quench systems already in place.

It has been found possible to integrate the required high pressure steam superheater in the convection section of a heavy feed furnace in a manner that both provides the required superheat for efficient turbine operation, and significantly reduces the formation of coke in the convection tubes upstream of the flash/separation vessel. By appropriately locating the high-pressure steam superheater in the convection section, the propensity of the heavy hydrocarbon feedstock to produce coke can be reduced. Specifically, the high pressure steam superheater can be located in the convection section of the furnace so that it is downstream (with respect to the flow of flue gas through the convection section of the furnace) of the zone where the flash/separation vessel overhead vapor is superheated, but is upstream of the zone where the mixed stream and/or the heavy hydrocarbon feedstock is heated. In this manner the heat absorbed by the high-pressure steam superheater ensures that the flue gas entering the mixed stream heating zone is cooled sufficiently that film temperatures do not reach levels at which coking occurs, typically about 950 to about 1150° F. (510 to 620° C.) depending on the composition of the heavy hydrocarbon feedstock. Thus, the danger of forming coke in the tubes upstream of the flash/separation vessel is significantly reduced. The heavy hydrocarbon fractions that accelerate coking in the radiant and quench systems of the furnace are removed from the furnace as the liquid phase stream removed as the flash/separation vessel bottoms.

In the furnace illustrated in FIG. 1, coking problems are avoided in the first tube bank in the convection zone, where the heavy hydrocarbon feedstock and/or the mixture stream are heated, because the feed is not fully vaporized and the flue gas is sufficiently pre-cooled by the high pressure steam superheater to prevent film temperatures in the first tube bank reaching a coking temperature, generally between about 950 and about 1150° F. (510 to 620° C.), depending on the heavy hydrocarbon feedstock.

The overhead vapor from the flash/separation vessel is optionally heated to a higher temperature for passing to the radiant (cracking) zone of the pyrolysis furnace. In the radiant zone the feed is thermally cracked to produce an effluent comprising olefins, including ethylene and other desired light olefins, and byproducts.

In most commercial liquid crackers, cooling of the effluent from the cracking furnace is normally achieved using a system of transfer line heat exchangers, a primary fractionator, and a water quench tower or indirect condenser. For a typical naphtha feedstock, the transfer line heat exchangers cool the process stream to about 700° F. (370° C.), efficiently generating high pressure steam that can then be used elsewhere in the process. High pressure steam shall mean steam with a nominal pressure of approximately 550 psig and higher, often about 1200 to about 2000 psig, for example, about 1500 to about 2000 psig. The radiant section effluent resulting from cracking a heavy hydrocarbon feedstock in the present invention can be rapidly cooled in a transfer-line exchanger 42, generating high pressure steam 48 in a thermosyphon arrangement with a steam drum 47.

The steam generated in transfer line exchangers can be used to drive large steam turbines which power the major compressors used elsewhere in the ethylene production unit. To obtain high energy efficiency and power production in the steam turbines, it is necessary to superheat the steam produced in the transfer line exchangers. For example, in a nominal 1500 psig steam system, the steam would be produced at approximately 600° F. (315° C.) and would be superheated in the convection section of the furnace to about 800 to about 1100° F. (425 to 590° C.), for example about 850 to about 950° F. (455 to 510° C.) before being consumed in the steam turbines.

The saturated steam 48 taken from the drum is preferably superheated in the high pressure steam superheater bank 49. To achieve the optimum turbine inlet steam temperature at all furnace operating conditions, an intermediate desuperheater (or attemperator) 54 may be used in the high pressure steam superheater bank. This allows the superheater 49 outlet temperature to be controlled at a constant value, independent of furnace load changes, coking extent changes, excess oxygen level changes, and other variables. Normally, this desuperheater 54 would maintain the temperature of the high pressure steam between about 800 and about 1100° F. (425 and 590° C.), for example between about 850 and about 1000° F. (450 and 540° C.), such as between about 850 and about 950° F. (450 and 510° C.). The desuperheater can be a control valve and water atomizer nozzle. After partial heating, the high pressure steam exits the convection section and a fine mist of water 51 is added which rapidly vaporizes and reduces the temperature. The high pressure steam is then further heated in the convection section. The amount of water added to the superheater can control the temperature of the steam.

To allow the desired heavy hydrocarbon feedstock streams to be cracked without forming coke in the first tube bank, the high pressure steam superheater can be located in the convection section such that it is downstream (with respect to the flow of flue gas from the radiant section of the furnace) of the vapor phase superheater and upstream of the first tube bank.

The use of an attemperator (intermediate desuperheater) is preferable to the use of a desuperheater after the high pressure steam exits the convection section since the superheater with an attemperator removes more heat from the flue gas when the high pressure steam generation rates are reduced. Reduced high temperature steam generation occurs, for example, as the transfer line exchangers foul over time because of tar production inherent in processing heavier feedstocks.

After being cooled in the transfer line exchanger, the furnace effluent may optionally be further cooled by injection of a stream of suitable quality quench oil.

Positioning the high pressure steam superheater bank such that it cools the flue gas prior to the flue gas contacting the tubes containing heavy hydrocarbon feedstock or mixture stream allows control of the flue gas temperature such that film temperatures are maintained below a level at which coking would occur. The temperature of the flue gas entering the top convection section tube bank is generally less than about 1500° F. (815° C.), for example, less than about 1300° F. (705° C.), such as less than about 1150° F. (620° C.), and preferably less than about 1000° F. (540° C.).

What is claimed is:

1. A process for cracking a heavy hydrocarbon feedstock, said process comprising:

(a) heating a heavy hydrocarbon feedstock in a pyrolysis furnace, said pyrolysis furnace comprising a radiant section and a convection section;

(b) mixing the heated heavy hydrocarbon feedstock with a liquid outside of said pyrolysis furnace in a first sparger of a double sparger, and with primary dilution steam stream in a second sparger of said double sparger to form a mixture stream, and heating the mixture stream in said first convection section tube bank of said pyrolysis furnace;

(c) flashing the mixture stream to form a vapor phase and a liquid phase;

(d) removing the liquid phase in a flash/separation vessel;

(e) cracking the vapor phase in a radiant section of the pyrolysis furnace to produce an effluent comprising olefins; and (f) quenching the effluent using a transfer line exchanger, wherein the amount of the liquid relative to the steam mixed with the heavy hydrocarbon feedstock is varied in accordance with at least one selected operating parameter of the process.

2. The process of claim 1, wherein the at least one operating parameter of the process is the temperature of the mixture stream before the mixture stream is flashed.

3. The process of claim 1, wherein the at least one operating parameter is at least one of pressure of the flash/separation vessel, temperature of the flash/separation vessel, flow rate of the mixture stream, and excess oxygen in the flue gas of the furnace.

4. The process of claim 1, wherein the heavy hydrocarbon feedstock comprises one or more of steam cracked gas oil and residues, gas oils, heating oil, jet fuel, diesel, kerosene, gasoline, coker naphtha, steam cracked naphtha, catalytically cracked naphtha, hydrocrackate, reformate, raffinate reformate, Fischer-Tropsch liquids, Fischer-Tropsch gases, natural gasoline, distillate, virgin naphtha, atmospheric pipestill bottoms, vacuum pipestill streams including bottoms, wide boiling range naphtha to gas oil condensates, heavy non-virgin hydrocarbon streams from refineries, vacuum gas oils, heavy gas oil, naphtha contaminated with crude, atmospheric residue, heavy residue, $C_4$'s/residue admixture, naphtha/residue admixture, gas oil/residue admixture, and crude oil.

5. The process of claim 1, wherein the heavy hydrocarbon feedstock is heated by indirect contact with flue gas in a first convection section tube bank of the pyrolysis furnace before mixing with the fluid.

6. The process of claim 5, wherein the temperature of the flue gas entering the first convection section tube bank is less than about 815° C.

7. The process of claim 5, wherein the temperature of the flue gas entering the first convection section tube bank is less than about 540° C.

8. The process of claim 1, wherein the liquid comprises at least one of hydrocarbon and water.

9. The process of claim 1, wherein the mixture stream is heated by indirect contact with flue gas in a first convection section tube bank of the pyrolysis furnace before being flashed.

10. The process of claim 9, wherein the temperature of the flue gas entering the first convection section tube bank is less than about 815° C.

11. The process of claim 9, wherein the temperature of the flue gas entering the first convection section tube bank is less than about 540° C.

12. The process of claim 1, wherein the primary dilution steam stream is heated in the convection section of the pyrolysis furnace.

13. The process of claim 1, wherein a secondary dilution steam stream is heated in a second convection section tube bank of the pyrolysis furnace and at least a portion of said secondary dilution steam stream is then mixed with the mixture stream before flashing the mixture stream.

14. The process of claim 13, wherein the secondary dilution steam stream is superheated.

15. The process of claim 1, wherein the temperature of the mixture stream before flashing in step (c) is from about 315 to about 540° C.

16. The process of claim 1, wherein the mixture stream is flashed at a pressure of about 40 to about 200 psia.

17. The process of claim 1, wherein about 50 to about 98 percent of the mixture stream is in the vapor phase after being flashed.

18. The process of claim 1, wherein the vapor phase is heated to a temperature above the temperature of the flash in a fourth convection section tube bank of the pyrolysis furnace prior to step (e).

19. The process of claim 18, wherein the fourth convection section tube bank is the convection section tube bank first contacted by flue gas leaving the radiant section of the furnace.

20. The process of claim 1, wherein a secondary dilution steam stream is heated in a second convection section tube bank of the pyrolysis furnace and at least a portion of said secondary dilution steam stream is then mixed with the vapor phase before step (e).

21. The process of claim 1, wherein the transfer line exchanger is used to produce high pressure steam and said high pressure steam is superheated to a temperature less than about 590° C. in a third convection section tube bank of the pyrolysis furnace by indirect contact with the flue gas before the flue gas enters the first convection section tube bank.

22. The process of claim 21, wherein the high pressure steam is superheated to a temperature of about 455 to about 510° C.

23. The process of claim 21, wherein an intermediate desuperheater is used to maintain the desired temperature of the high pressure steam leaving the third convection section tube bank.

24. A process for cracking a heavy hydrocarbon feedstock, said process comprising:

(a) heating a heavy hydrocarbon feedstock in a pyrolysis furnace, said pyrolysis furnace comprising a radiant section and a convection section, said convection section comprising a first convection section tube bank, a second convection section tube bank, and a third convection section tube bank;

(b) mixing the heated heavy hydrocarbon feedstock separately with a liquid in a first sparger of a double sparger, and with primary dilution steam stream in a second sparger of said double sparger outside of said pyrolysis furnace to form a mixture stream;

(c) heating the mixture stream in said first convection section tube bank of said pyrolysis furnace; then (d) flashing the mixture stream to form a vapor phase and a liquid phase;

(e) removing the liquid phase in a flash/separation vessel;

(f) cracking the vapor phase in a radiant section of said pyrolysis furnace to produce an effluent comprising olefins;

(g) quenching the effluent using a transfer line exchanger, wherein the transfer line exchanger is used to produce high pressure steam; and (h) superheating the high pressure steam in the third convection section tube bank, the third convection section tube bank being located such that flue gas leaving the radiant section of the pyrolysis furnace contacts the third convection section tube bank prior to contacting the first convection section tube bank.

25. The process of claim 24, wherein the high pressure steam is superheated to a temperature less than about 590° C.

26. The process of claim 25, wherein the high pressure steam is superheated to a temperature of about 455 to about 510° C.

27. The process of claim 24, wherein an intermediate desuperheater is used to maintain the desired temperature of the high pressure steam leaving the third convection section tube bank.

28. The process of claim 24, wherein the heavy hydrocarbon feedstock is heated by indirect contact with flue gas in a first convection section tube bank of the pyrolysis furnace before mixing with the fluid.

29. The process of claim 24, wherein the liquid comprises at least one of hydrocarbon and water.

30. The process of claim 24, wherein the mixture stream is heated by indirect contact with flue gas in a first convection section tube bank of the pyrolysis furnace before being flashed.

31. The process of claim 24, wherein the temperature of the flue gas entering the first convection section tube bank is less than about 620° C.

32. The process of claim 24, wherein the temperature of the mixture stream before flashing in step (c) is from about 310 to about 530° C.

33. The process of claim 24, wherein the mixture stream is flashed at a pressure of about 40 to about 200 psia.

34. The process of claim 24, wherein about 50 to about 98 percent of the mixture stream is in the vapor phase after being flashed.

35. The process of claim 24, wherein the vapor phase is heated to a temperature above the temperature of the flash in a fourth convection section tube bank of the pyrolysis furnace prior to step (e).

* * * * *